United States Patent [19]

Steffens

[11] Patent Number: 4,669,379

[45] Date of Patent: Jun. 2, 1987

[54] INK TRANSFER ARRANGEMENT AND METHOD IN A PRINTING PRESS

[76] Inventor: Robert S. Steffens, 56 W. Newell Ave., Rutherford, N.J. 07070

[21] Appl. No.: 832,171

[22] Filed: Feb. 21, 1986

Related U.S. Application Data

[63] Continuation of Ser. No. 611,319, May 17, 1984, abandoned.

[51] Int. Cl.[4] ..... B41F 1/46

[52] U.S. Cl. ..... 101/164; 101/362

[58] Field of Search ..... 101/163, 164–166, 101/160, 161, 159, 295, 290, 292, 320, 321, 323, 326, 360, 361, 362, 199, 295, 207–210, 359

[56] References Cited

U.S. PATENT DOCUMENTS

| | | | |
|---|---|---|---|
| 657,144 | 9/1900 | Waite | 101/164 |
| 1,102,770 | 7/1914 | Lockwood | 101/164 |
| 1,789,244 | 1/1931 | McCollum | 101/348 |
| 3,744,414 | 7/1973 | Krochert | 101/148 |
| 3,760,723 | 9/1973 | Taig | 101/DIG. 6 |
| 4,290,359 | 9/1981 | Kapoor | 101/350 X |

*Primary Examiner*—J. Reed Fisher

*Attorney, Agent, or Firm*—Kirschstein, Kirschstein, Ottinger & Israel

[57] ABSTRACT

An ink transfer arrangement for and a method of transferring ink to an engraved die surface of a reciprocatable die in a printing press of the type including a die drive for reciprocating the die, and a press ram drive for pressing sheet material to be printed against the ink engraved die surface to produce intaglio printing are disclosed. A rotatable inking roller is normally mounted on an ink fountain in inking engagement with a fountain roller also mounted on the fountain. Ink from the fountain is transferred to the fountain roller, and thereupon to the inking roller. The inking roller is mounted for limited displacement relative to the fountain roller in a direction transverse to the axis of rotation of the inking roller. A set of cam shoes and cam follower wheels are provided in operative association with the die drive for displacing the inking roller by a limited predetermined distance out of inking engagement with the fountain roller and into inking engagement with the engraved die surface to permit the ink-laden inking roller to roll over and apply ink to the engraved die surface during the reciprocating movement of the die. Intaglio printing speeds on the order of 8000 impressions per hour are achieved.

26 Claims, 14 Drawing Figures

FIG. 12
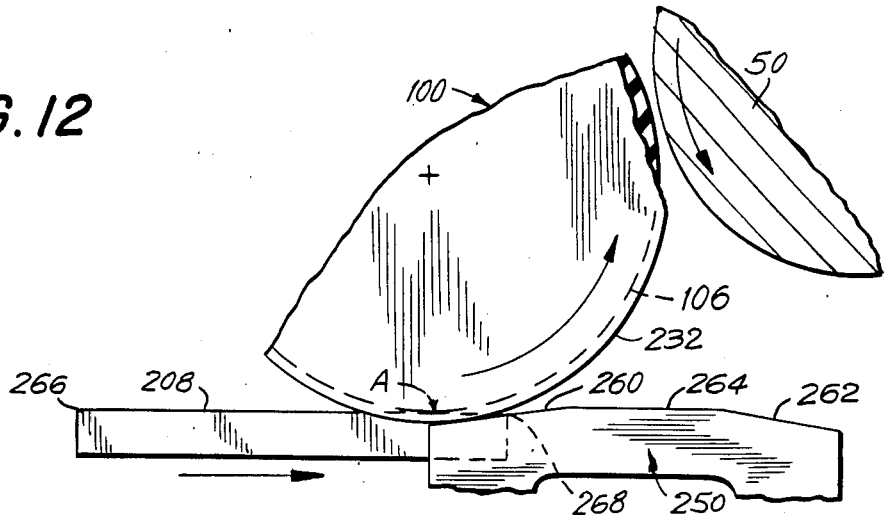
FIG. 13
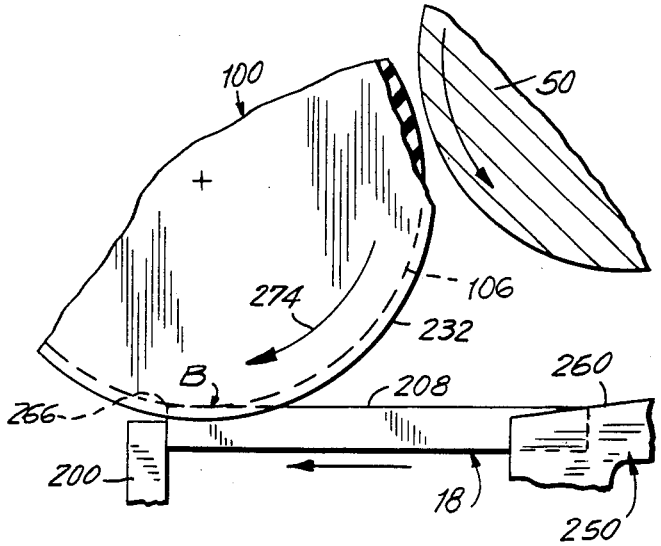
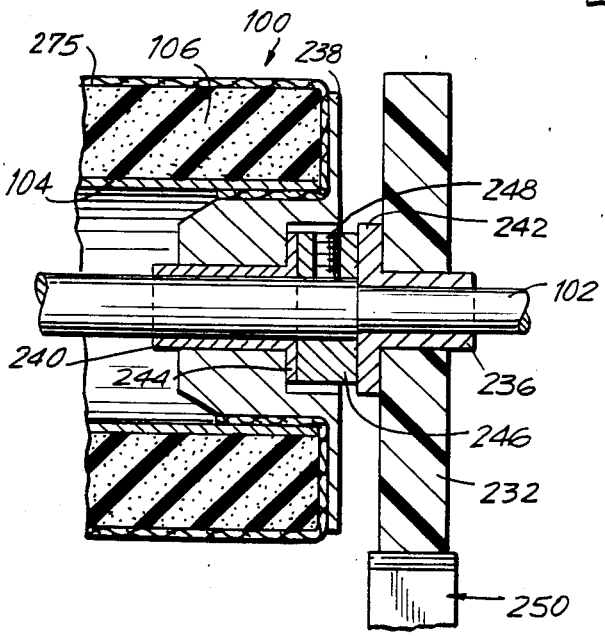
FIG. 14

INK TRANSFER ARRANGEMENT AND METHOD IN A PRINTING PRESS

This is a continuation of application Ser. No. 611,319, filed May 17, 1984, now abandoned.

BACKGROUND OF THE INVENTION

1. Field of the Invention

This invention generally relates to an ink transfer arrangement for and method of transferring ink to an engraved die surface of a reciprocating die in a printing press and, more particularly, in an intaglio die stamping and embossing press for producing engraved stationery.

2. Description of the Prior Art

Intaglio printing on paper from an engraved line is thought to have originated in the fifteenth century. Typically, a fifteenth century artist would hand engrave a portrait on a plate and, after applying ink over the engraved plate, the portrait was printed by means of a manually operated plate press.

It was not until the turn of the twentieth century that motor driven die stamping and embossing presses of the type disclosed in U.S. Pat. Nos. 558,860; 695,542 and 842,865 were developed. These presses included an ink fountain for containing a supply of ink, a die having an engraved surface, an ink transfer arrangement for transferring ink from the ink supply to the engraved die surface, and a vertically reciprocatable press ram for pressing sheet material such as paper against the inked die surface to produce engraved stationery. At the time, and for many years later, the paper to be printed was hand fed to the printing press, typically at maximum speeds of about 1500 to 2500 impressions per hour. The advent of automatic paper feeders increased maximum printing speeds to about 2500 to 4000 impressions per hour. Sometime around 1940, thermography, also called raised printing, made serious inroads into the production and sale of genuine engraved stationery. The maximum printing speeds at which letterpress or offset presses could be run was much faster than that of the die stamping presses. Some examples of offset presses are disclosed in U.S. Pat. Nos. 2,546,793; 2,737,109; 2,788,742; 3,347,160; 3,412,677; 3,505,952; 3,611,924; 3,701,316 and 3,934,508. A color inking attachment for a printing press is shown in U.S. Pat. No. 2,096,385.

All of the aforementioned die stamping presses from their beginning and, indeed, up to the present time, have used similar ink transfer arrangements to transfer the ink from the ink supply in the ink fountain to the engraved die surface of the die prior to pressing by the press ram. Typically, for example in U.S. Pat. No. 842,865, a cylindrical inking roller is connected at its opposite ends to the ends of a pair of transfer arms about 8" to 10" long. The transfer arms carry the inking roller and pivot in a large arc, typically greater than 30°. When the transfer arms carry the inking roller upwardly, the inking roller picks up ink from a main cylindrical fountain roller that is partially immersed in the ink fountain. When the transfer arms carry the inking roller downwardly, the ink-laden inking roller deposits and distributes its ink over the engraved die surface. The arcuate distance traveled is about 8" to 10" upwardly and downwardly, depending on the press in question.

There are numerous disadvantages to the aforementioned prior art ink transfer arrangement. Primarily, the maximum printing speed at which the die stamping press can be operated is limited by the time taken to ink the die by the inking roller. The longer the distance through which the inking roller moves, the slower is the maximum printing speed. Faster printing speeds were a primary consideration in the development of thermography.

When the speed of the transfer arms is increased beyond a certain point, ink is thrown off from the inking roller all over the adjacent parts of the press. In most cases, depending on the viscosity of the ink, the upper speed limit of the printing process is in the neighborhood of 4500 impressions per hour. A very large percentage of the ink in current use is water-based ink which has a relatively low viscosity, thereby worsening the ink-throwing problem.

In addition, because of the relatively long time interval involved in moving the inking roller from the die to the ink fountain and back, the portion of the printing cycle during which the inking roller is in inking engagement with the fountain roller is very small. Hence, the fountain roller must be rotated at excessive speeds so that it can completely cover and distribute ink over the entire outer circumferential surface of the inking roller during that small portion of the printing cycle. However, the fountain roller is subject to overheating at higher speed, with concomitant vaporization of the ink. The higher printing speeds also result in larger magnitude vibrations which, in turn, have been found to develop undesirable harmonics, causing the transfer arms and the inking roller carried thereon to act in an uncontrollable fashion.

Other problems with known die stamping presses involved such difficulties as cleaning the ink transfer arrangement, replacing the components thereof and adjusting the positions of the components thereof. The fountain roller was typically virtually permanently mounted on the fountain, and it was difficult and time consuming to replace the fountain roller. The position of the inking roller relative to the fountain roller was typically not readily adjustable except by laborious procedures. When an auxiliary fountain roller was used in conjunction with the main fountain roller to meter superfluous ink from the latter and thereby control the thickness of the ink layer thereon, it was typically very painstaking to finely adjust the position of the auxiliary roller. Periodic cleaning of the ink transfer arrangement was typically lengthy in duration. In the event that any of the aforementioned rollers had to be removed from their normal operating positions and replaced and/or cleaned, then extensive readjustment of the various components was necessary, thereby leading to long periods of down time, with concomitant high overhead and labor costs.

SUMMARY OF THE INVENTION

1. Objects of the Invention

Accordingly, it is an object of the present invention to overcome the aforementioned drawbacks of prior art die stamping and embossing presses.

It is another object of the present invention to increase the maximum printing speeds of die stamping presses.

It is a further object of the present invention to no longer limit the printing speed by the relatively long time interval it previously took to complete inking of the die.

It is yet another object of the present invention to rotate the fountain rollers at a slower speed without sacrificing production, to prevent overheating of the fountain rollers and the ink.

It is still another object of the present invention to prevent throwing of the ink and ink vaporization.

It is another object of the present invention to prevent uncontrolled vibrations at increased printing speeds.

It is a still further object of the present invention to rapidly disengage the inking roller, the main fountain roller and the auxiliary fountain roller from their respective mountings on the ink fountain, and to rapidly clean and/or replace said rollers back in their respective operating positions.

It is yet another object of the present invention to rapidly and finely adjust the position of the inking roller and of the auxiliary fountain roller relative to the main fountain roller.

It is still another object of the present invention to rapidly disengage the auxiliary fountain roller from the main fountain roller without disturbing the inking engagement between the main fountain roller and the inking roller.

It is a further object of the present invention to so yieldably mount the main and auxiliary fountain rollers as to prevent damage thereto in the event that a foreign object enters the nip between said rollers.

It is another object of the present invention to readily move the ink fountain, the inking roller, the main fountain roller and the auxiliary fountain roller as a unit away from their operating position adjacent the die to a more rearward cleaning position remote from the die to permit access to the die for cleaning purposes, as well as to permit access to the ink transfer arrangement itself for cleaning purposes.

It is a further object of the present invention to provide a novel method of transferring ink from an ink fountain to an engraved die surface in an intaglio printing press.

2. Brief Description of the Invention

In keeping with these objects, and others which will become apparent hereinafter, one feature of the invention resides, briefly stated, in an ink transfer arrangement for and a method of transferring ink to an engraved die surface of a reciprocatable die in a printing press of the type including a die drive for reciprocating the die, and a press ram drive for pressing sheet material to be printed against the inked engraved die surface to produce intaglio printing.

The ink transfer arrangement advantageously comprises an ink fountain mounted on the press and containing a pool of ink. A rotatable fountain roller is mounted on the fountain and has at least a portion of its outer circumferential surface in inking communication with the ink from the pool. Means are provided for rotating the fountain roller to distribute ink from the pool circumferentially along the outer circumferential surface of the fountain roller during rotation of the same.

In further accordance with this invention, a rotatable inking roller is normally mounted in inking engagement with the fountain roller for rotation by the same about an axis. The inking roller has an outer circumferential surface along which ink is distributed by the outer circumferential surface of the fountain roller during rotation of the same. The inking roller is also mounted for limited displacement relative to the fountain roller in a direction transverse to the axis of rotation of the inking roller. Displacing means are also provided in operative association with the die drive for displacing the inking roller by a limited predetermined distance out of inking engagement with the fountain roller, and into inking engagement with the engraved die surface to permit the ink-laden inking roller to roll over and apply ink to the engraved die surface during the reciprocating movement of the die.

The limited distance through which the inking roller is displaced is typically on the order of ⅛". When compared to the large arcuate distance through which a prior art inking roller was moved, the inking roller of this invention can be considered, for all practical purposes, to be virtually motionless. The maximum printing speed is no longer limited by the excessively long time interval previously needed to effect inking. Typical maximum printing speeds achieved by the present invention are on the order of 8000 impressions per hour, which represents a significant improvement over the previous maximum printing speeds for die stamping presses, which were on the order of 4000 impressions per hour.

The limited displacement of the inking roller also eliminates the problem of ink that can be thrown therefrom. In addition, the fountain roller can be rotated at slower speeds than previously without sacrificing production efficiency, because the inking roller is in inking engagement with the fountain roller for a greater portion of each printing cycle. The slower fountain roller is thus prevented from overheating, as well as from causing the ink thereon to vaporize.

Another feature of this invention advantageously resides in mounting the ink fountain on a carriage and moving the carriage away from its normal operating position to a cleaning position to permit cleaning. Access is thereby provided to the engraved die, as well as to the portions of the press vacated by the moved carriage.

Another advantageous feature of this invention is embodied in means for readily removably mounting the fountain roller on the fountain to permit ready removal. In this same vein, a rotatable auxiliary roller operative for milling ink and also for metering superfluous ink from the fountain roller is also readily removably mounted on the fountain. The auxiliary roller is adjustably mounted closely adjacent the fountain roller to control the thickness of the layer of the ink on the same. The Auxiliary roller, like the fountain roller, likewise rotates at slower speeds than heretofore, and is thus prevented from overheating as well as from causing the ink thereon to vaporize.

In furtherance of this invention, the inking roller is adjustably mounted on opposite sides of the fountain on a pair of support arms. The inking roller is readily removable from the arms, and its position relative to the fountain roller can be finely adjusted.

The inking roller can be rapidly disengaged from its position in inking engagement with the main fountain roller without disturbing the inking engagement between the auxiliary and the main fountain roller. Similarly, the auxiliary roller can be rapidly disengaged from the main fountain roller without disturbing the inking engagement between the latter and the inking roller.

In a preferred embodiment, the displacing means includes a pair of cam follower wheels mounted at opposite end regions of the shaft on which the inking roller is mounted, and a pair of cam shoes operatively connected with the die drive to jointly move with the reciprocating movement of the die. Each shoe engages a respective wheel during a part of the reciprocating movement to effect the aforementioned limited displacement. Advantageously, each shoe has a rear portion for lifting the respective wheel and, in turn, the inking roller out of inking engagement with the fountain roller, and a front portion for lowering the respective wheel and, in turn, the inking roller into rolling, inking contact with the engraved die surface. When the die drive moves the die and the shoes along a rearward stroke in a rearward direction toward the inking roller, the inking roller first contacts the engraved die surface at a location spaced forwardly of a rear edge of the die. At the conclusion of the rearward stroke, the inking roller maintains contact with the die at a location spaced rearwardly of a front edge thereof.

When the die drive returns the die and the shoes along a forward stroke in the forward direction away from the inking roller, the inking roller rolls along the engraved die surface until the front portion of each shoe lifts the respective wheel and, in turn, the inking roller out of rolling, inking contact with the engraved die surface. Thereupon, the rear portion of each shoe lowers the respective wheel during further forward movement and, in turn, the inking roller is lowered and returned into inking engagement with the fountain roller. The aforementioned rearward and forward strokes are alternately repeated.

The novel features which are considered as characteristic of the invention are set forth in particular in the appended claims. The improved device itself, however, both as to its construction and its mode of operation, together with additional features and advantages thereof, will be best understood upon perusal of the following detailed description of certain specific embodiments with reference to the accompanying drawings.

BRIEF DESCRIPTION OF THE DRAWINGS

FIGS. 9–13 are partially broken away schematic views of the ink transfer action during successive portions of a rearward stroke of the die drive; and FIG. 14 is an enlarged sectional partially broken away view of a detail of the ink transfer arrangement in accordance with this invention.

DETAILED DESCRIPTION OF THE PREFERRED EMBODIMENT

Figure 1:
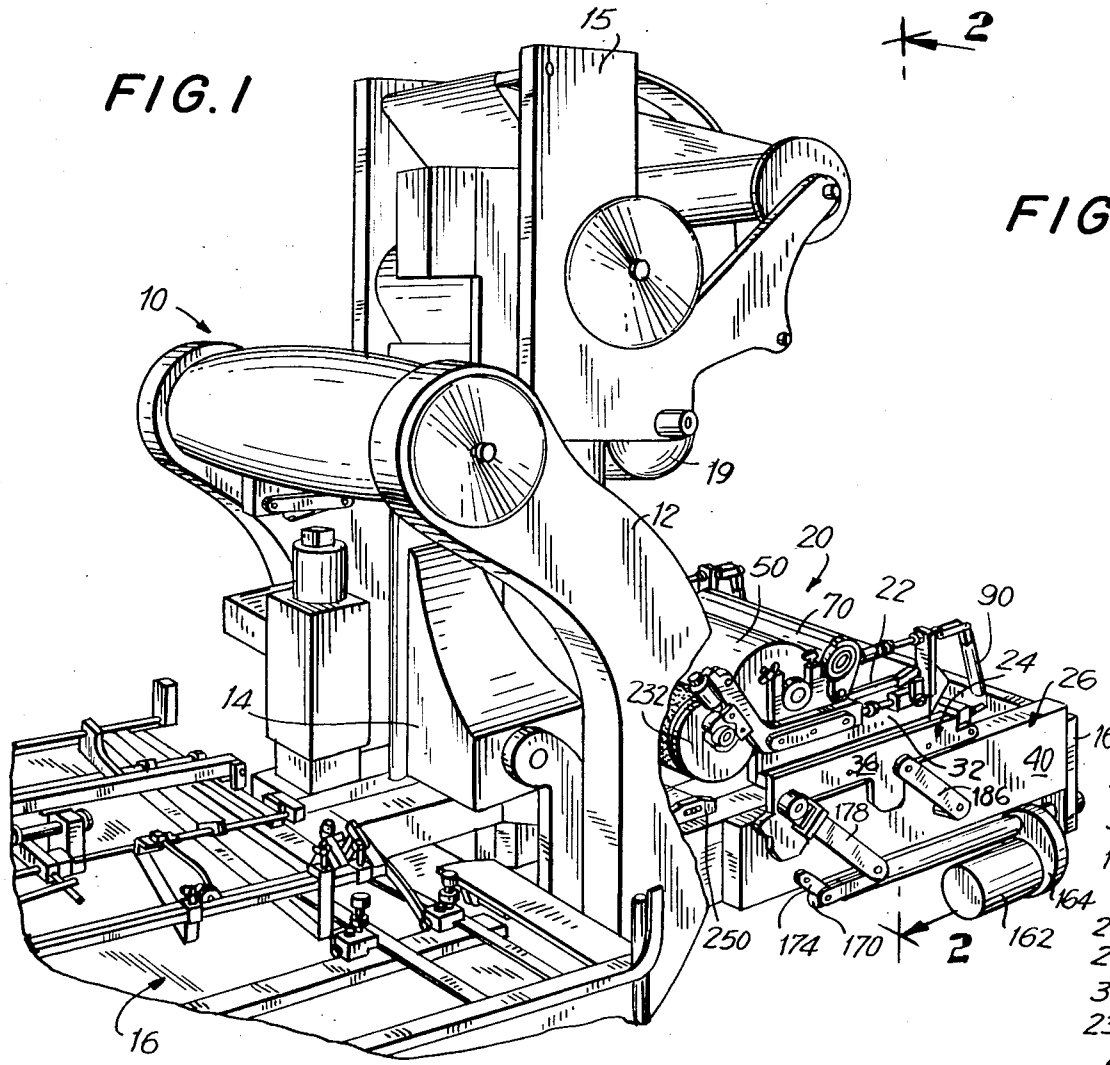
FIG. 1 is a partially broken away view of an intaglio printing press showing a front perspective view of the ink transfer arrangement in accordance with this invention.

Referring now to the drawings and, more particularly, to FIG. 1 thereof, reference numeral 10 generally identifies an intaglio printing press having a floor-mounted stationary upright frame 12 on the front of which a press ram drive 14 is mounted for generally vertical reciprocating movement. An automatic sheet material feeder 16 is located at the front of the press for automatically feeding successive sheet materials, e.g. paper, to be printed underneath the ram drive 14 for individual subsequent pressing against an inked engraved die surface of a generally horizontally reciprocating die 18, as described below, to produce genuine engraved stationery. An overhead paper wiping and feeding arrangement 15 on which a supply of wiping paper 19 is mounted is employed in conventional manner to wipe excess ink off the inked engraved die surface of the die. Inasmuch as the ram drive 14, automatic paper feeder 16, and the paper wiping and feeding arrangement 15 are entirely conventional in this art, additional structural and functional details thereof are not believed to be necessary for an understanding of this invention which, as noted above, is more particularly directed to an ink transfer arrangement 20 that is located at the rear of the press as viewed in FIG. 1.

Figure 4:
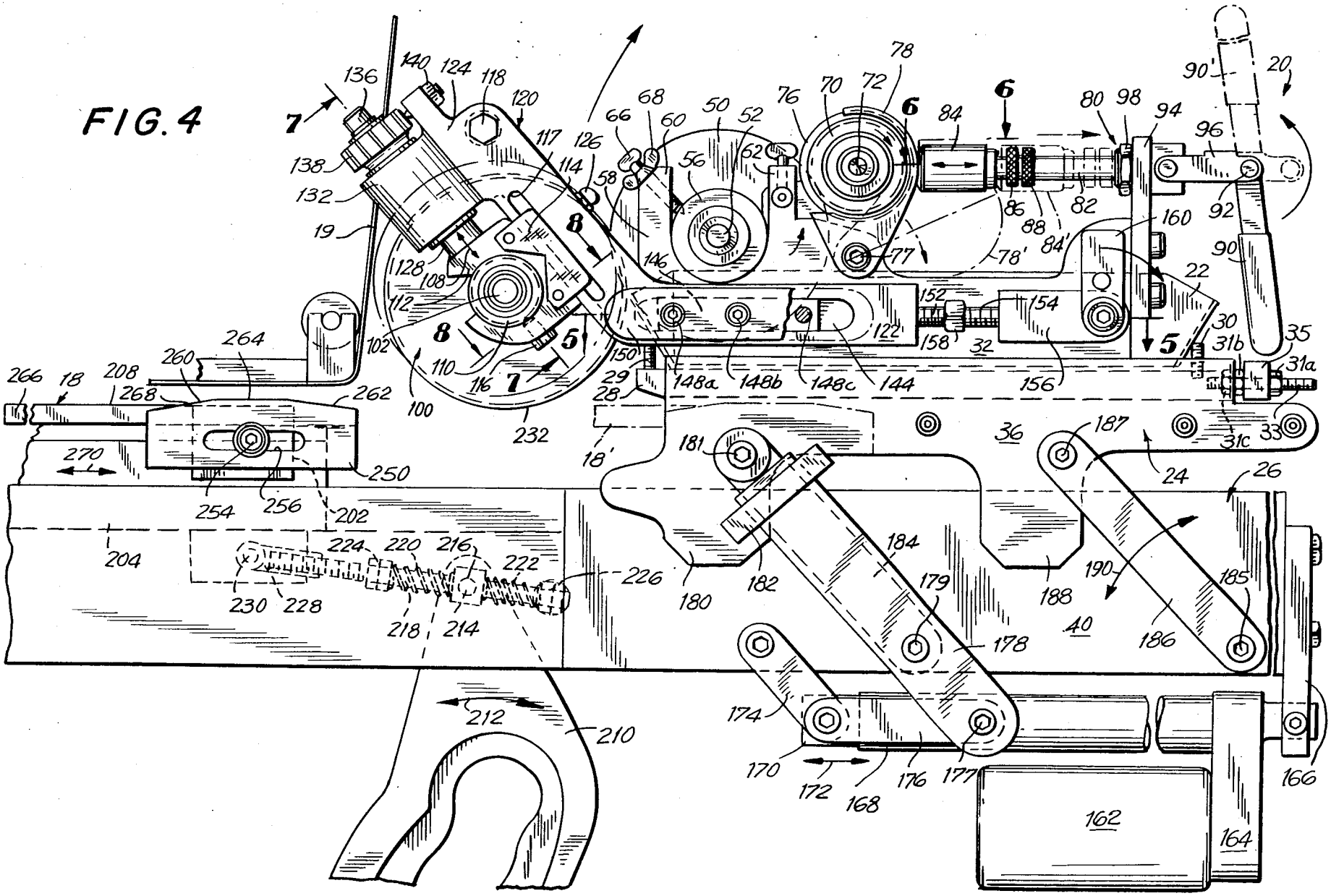
FIG. 4 is a partially broken away right side view of the arrangement of FIG. 1 as taken along the line 4—4 of FIG. 3.

As best shown in FIGS. 1 and 4, the ink transfer arrangement 20 includes an ink fountain 22 in which a pool of ink is contained. The fountain 22 is shaped as a generally rectangular shallow pan, and is mounted on a carriage 24 that is, in turn, mounted on a horizontally extending bed 26 of the press. The carriage 24 includes a base 28; a pair of upper side walls 32, 34 located at opposite lateral sides of the fountain 22 to restrain side-to-side movement of the fountain relative to the carriage; and a pair of lower side walls 36, 38 outwardly offset from, and extending downwardly generally parallel to, the upper side walls 32,34.

The carriage 24 includes a front stop 29 and a rear stop 30, both mounted on the base and respectively located at the front and rear of the fountain 22 to restrain to-and-fro movement of the fountain relative to the carriage. The position of the fountain relative to the lower side walls 36, 38 is adjustable in the horizontal direction by turning a set of knurled adjusting nuts **31*a*, 31*b*, 31*c* along a threaded elongated rod 33, said nuts and rod being provided on opposite lateral sides of the fountain. Each rod 33 is threaded into the lower side walls 36, 38 of the carriage. A cross-block 35 extends transversely across the fountain, and is connected to the rear of the base 28. Each nut 31*a* engages one side of the block 35, and each pair of nuts 31*b*, 31*c* is located at the opposite side of the block 35. When the nuts 31*a*, 31*b*, 31*c* are tightened against the cross-block 35, the position of the base 28 and all the superstructure thereon is adjustably restrained relative to the lower side walls 36, 38 of the carriage 24**.

Figure 2:
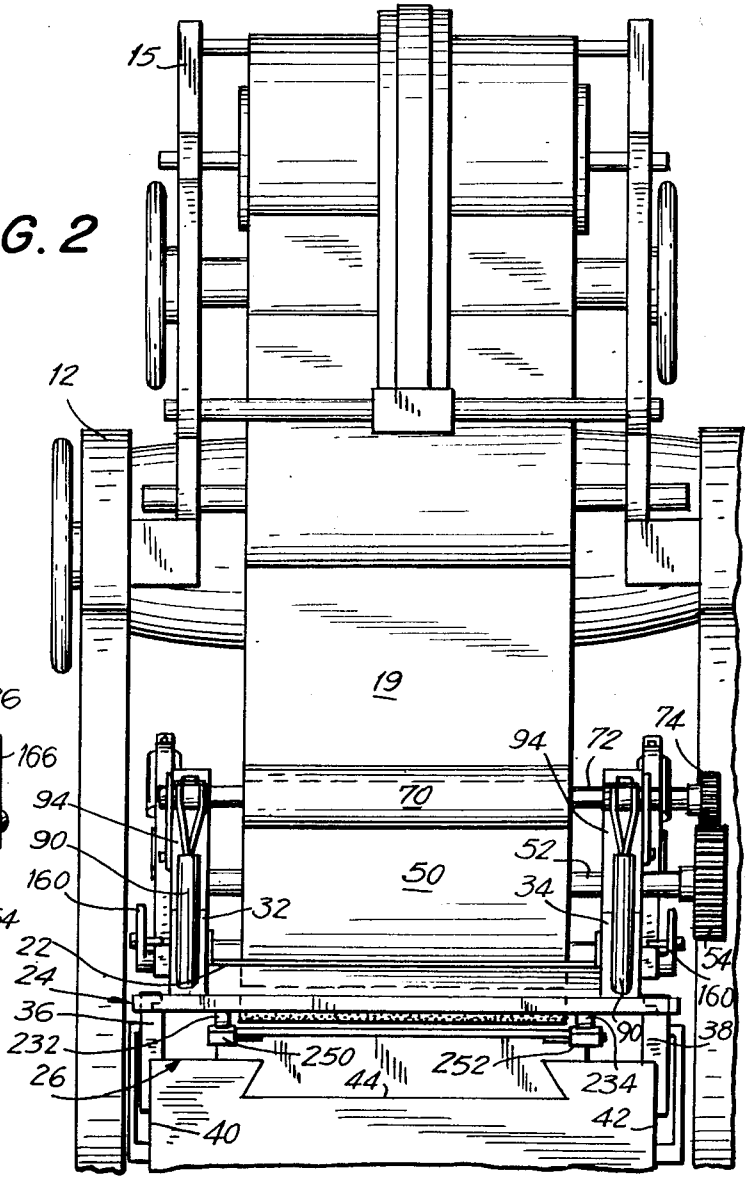
FIG. 2 is a rear view of the arrangement of FIG. 1 as taken along the line 2—2.

In addition, the lower side walls 36, 38 extend downwardly, at least in part, along a pair of outer side walls 40, 42 located at opposite sides of the press bed 26. As will be explained in further detail below, the bed 26 has a horizontally extending undercut channel 44 (see FIG. 2) between the outer side walls 40, 42, said channel 44 providing clearance for the die 18 during its reciprocating movement.

A rotatable large or main fountain roller 50 having a cylindrical metallic body centered on a horizontal shaft 52 is mounted at the front region of the fountain 22 so that at least a portion of its outer circumferential surface is in inking communication with the ink supply in the fountain. As shown in FIG. 4, the lower side of the fountain roller 50 is immersed in the ink pool. Drive means are provided for rotating the fontain roller about a horizontal axis to distribute ink from the pool circumferentially and axially along the outer circumferential surface of the fountain roller during rotation of the same. The drive means includes a large drive gear 54 operatively connected to a non-illustrated motor drive, and fixedly mounted at one axial end of the shaft 52 (see FIG. 3) to turn the fountain roller 50 at a predetermined angular speed. Axially spaced-apart portions of the shaft 52 are respectively journaled in circular bearings 56 (only the one on the right side of the press being shown, it being understood that the bearing on the left side of the press has been omitted for clarity), each bearing 56 having an internal ball bearing rat race to minimize frictional drag.

Each circular bearing 56 is supported in a circumferentially incomplete C-shaped support 58 which is connected to or integral with and extends upwardly from the upper carriage side walls 32, 34. Each bearing support 58 has a pair of upright projections 60, 62 which together bound an upwardly open recess in which the respective circular bearing 56 is supported.

Each circular bearing is advantageously provided with an annular locking groove 64 (see FIG. 3) in which a leading end of a turnable locking element 66 is received. The elment 66 is advantageously threadedly mounted on projection 60, and the leading end of element 66 is lockingly received in the groove 64 by tightening a wing nut 68 against the projection 60. The element 66 need not necessarily be received in its associated groove 64. If desired, each element may be employed to firmly press each bearing 56 downwardly into its associated support to thereby anchor the bearing in place therein. The locking element 66 prevents axial shifting in the side-to-side direction of the fountain roller relative to the carriage, and also prevents the fountain roller from being lifted out of the upwardly open C-shaped supports 58 unless the leading ends of the locking elements 66 have been removed from their locking grooves 64. Untightening the wing nuts 68 provides for a rapid replacement and/or cleaning of the fountain roller.

A rotatable small or auxiliary fountain roller 70 having a cylindrical metallic body centered on a horizontal shaft 72 is mounted rearwardly of the main roller 50 in close confronting relationship therewith for the purpose of controlling the thickness of the layer of ink on the main roller. The auxiliary roller 70 serves as a miller and also meters excess ink from the main fountain roller, and also serves to smoothly and uniformly spread the ink layer over the entire outer circumferential surface of the main roller 50. The shaft 72 is elevated above the shaft 52, and the diameters of the larger main roller 50 and of the smaller auxiliary roller 70 are selected such that the nip therebetween is located at about the 2 o'clock position as viewed in FIG. 4.

The auxiliary roller is driven about a horizontal axis defined by the shaft 72 by a small drive gear 74 which meshingly engages the large drive gear 54 and is rotated by the same at an angular speed greater than said predetermined speed, said greater speed being dependent on the number of respective teeth on the gears 54 and 74.

In another embodiment, a separate motor drive for the small gear 74 could be employed.

Axially spaced-apart portions of the shaft 72 are journaled in circular bearings 76 (only one shown), each bearing 76 having an internal ball bearing rat race to reduce frictional drag. Each circular bearing 76 is supported in a circumferentially incomplete C-shaped support 78 which is pivotably connected to the upper carriage side walls at pivot points 77. Each C-shaped support 78 in its operating condition, as shown in FIG. 4, has a frontwardly facing open recess in which the bearings 76 are supported.

Means 80 are provided for adjustably positioning the auxiliary roller 70 at a predetermined selected radial distance from the main roller 50 in the aforementioned operating condition, as shown in solid lines in FIG. 4. Different radial distances between the main and auxiliary rollers determine the thickness of the ink layer on the former. The positioning means 80 are provided at both opposite lateral sides of the fountain, and each positioning means includes an elongated member 82 which extends in the direction of the desired adjustment, and an abutment 84 which is mounted at one end region of the elongated member 82 and which, in operating condition, engages the rear of the C-shaped support 78. Knurled nuts 86, 88 are turned to advance the abutment 84 in either direction along member 82 to adjustably set the position of the abutment 84.

At the opposite end region of the elongated member 82, a manually-operated handle or toggle lever 90 is mounted at pivot point 92 on a bracket 96. The toggle handle 90 is movable between its illustrated solid line position and its phantom line position 90'.

Each positioning means 80 is independently supported above the fountain 22 at the rear of the carriage by an upright support plate 94 with the aid of a tightenable nut 98 which engages one side of the plate 94.

Figure 6:
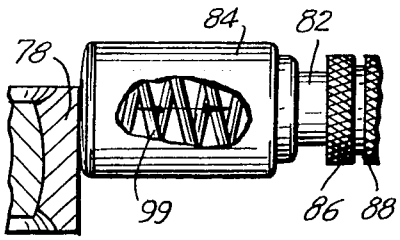
FIG. 6 is an enlarged sectional view as taken along the line 6—6 of FIG. 4.

As best shown in FIG. 6, a spring 99 is mounted within each abutment 84 for yieldably and constantly urging the latter against its respective C-shaped support 78 in the operating condition. In the event that a foreign object or contaminant enters the nip between the main and auxiliary rollers, this yielding action afforded by the spring 99 represents a safety feature which prevents damage to the rollers.

The solid line lowered position of of the handle 90 positions the abutment 84 in an engaged position against its associated support 78 and, in turn, properly positions the auxiliary roller 70 into inking engagement with the main roller 50. When the handle 90 is raised to the phantom line position 90', the abutment 84 is withdrawn to a released position 84' represented by phantom lines in which the abutment is disengaged from its associated support to permit each support 78 to pivot rearwardly to its lowered position 78'. Each support 78 in its lowered position 78' has an upwardly open recess from which the auxiliary roller can be easily lifted for rapid removal and replacement. Upon replacement of the auxiliary roller in its supports 78, the supports are tilted forwardly about pivot points 77 and, thereupon, the handles are manually lowered to thereby move the abutments 84 to their aforementioned engaged position. Thus, the auxiliary roller may be rapidly removed and replaced without requiring readjustment of the positioning between the auxiliary and main rollers, and without laborious adjusting procedures.

A rotatable inking roller 100, as shown in FIG. 4, is normally mounted in inking engagement with the main roller 50 for rotation by the same about a horizontal axis defined by a shaft 102. The inking roller has a cylindrical body 104 (see FIG. 7) centered on the shaft 102. The cylindrical body is covered with an ink-absorbing layer 106, preferably made of a durable, resilient material. Ink is distributed circumferentially and axially along the entire outer circumferential surface of the layer 106 by the outer circumferential surface of the main roller during rotation of the same.

The term "inking engagement" as used throughout the specification and the claims is intended to signify that one component need not necessarily, but preferably does, directly contact another component to transfer ink thereto, inasmuch as a thin layer of ink is interposed therebetween.

In contrast to the fountain rollers 50, 70, which are driven solely in their respective circumferential directions, as indicated by their associated arrows, the inking roller 100, as explained below, is rotatable in one or the other circumferential direction about its shaft 102 in the manner explained below.

In contrast to prior art constructions wherein the inking roller is carried by a pair of pivotable transfer arms and swung through a large arcuate distance, the inking roller 100 of this invention is mounted on the fountain and, more specifically, on the carriage for limited displacement relative to the main roller 50 in a direction generally transverse to the axis of rotation defined by the shaft 102, said direction being indicated by the double-headed arrow 108. Axially spaced-apart portions of the shaft 102 are journaled in circular bearings 110 (only one shown), each bearing 110 having an internal ball bearing rat race to reduce friction. Each bearing 110 is supportably mounted in a circumferentially incomplete C-shaped support 112. Each bearing 110 is provided with an annular locking groove 111 (see FIG. 7) into which a leading end of a locking screw 116 is lockingly received to prevent axial side-to-side shifting of the inking roller relative to the supports 112.

The inking roller 100 is mounted forwardly of the ink fountain 22 by a pair of generally V-shaped support arms 120, each having a horizontally extending rear leg 122 mounted at an opposite side of the carriage 24 on the upper side wall thereof, and an inclined front leg 124 extending upwardly and forwardly of the rear leg 122.

The front legs 124 are interconnected by a cross-rail 118 for increased stability. Each front leg 124 is also formed with a slot 117 which is elongated lengthwise of the front leg 124. Each of the aforementioned C-shaped supports 112 is connected to a channel-shaped bracket 114 that is mounted in the respective slot 117 for adjustable movement therealong. A locking screw 126 fixes the position of each bracket 114 and, in turn, the position of the inking roller along the length of the front leg 124.

Figure 7:
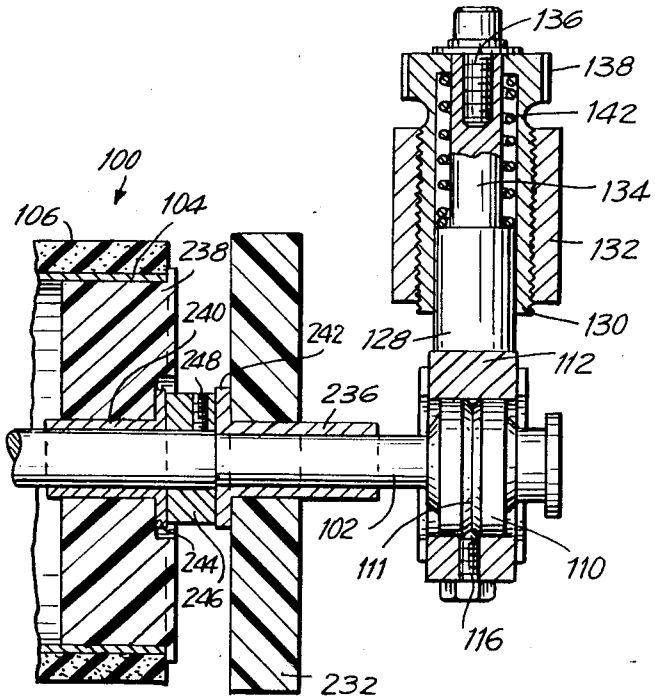
FIG. 7 is an enlarged sectional view as taken along the line 7—7 of FIG. 4.
Figure 8:
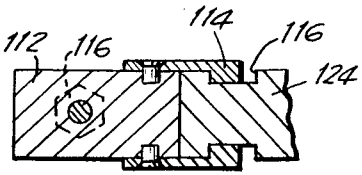
FIG. 8 is an enlarged sectional view as taken along the line 8—8 of FIG. 4.

As best shown in FIG. 7, each support 112 is connected to a cylindrical piston shaft 128 which is slidingly received in a cylindrical sleeve 130 having an external thread. An outer tubular collar 132 having an internal thread threadedly engages the externally threaded sleeve 130. An adjoining co-linear shaft 134 has a reduced diameter as compared to that of the piston shaft 128. A threaded fastener 136 has a threaded shaft which threadedly engages a tapped hole in the upper end of the reduced shaft 134. The upper end or neck of the sleeve 130 is unthreaded, and is formed with a plurality of equiangularly spaced-apart longitudinally extending teeth 138. The leading end of a locking screw 140 mounted in the upper region of each front leg 124 is lockingly received in a selected tooth 138 to prevent the sleeve 130 from turning.

A coil spring 142 is mounted in an annular clearance surrounding the reduced shaft 134. One end of the spring 142 bears against a shoulder formed at the junction between the piston shaft 128 and the reduced shaft 134. The opposite end of the spring 142 bears against an inner transverse wall of the sleeve 130 in the vicinity of its neck. Each spring 142 is normally operative to constantly and yieldably urge the supports 112 and, in turn, the inking roller itself downwardly and rearwardly into inking engagement with the main roller 50 to thereby assume an operating position shown in solid lines in FIG. 4.

Figure 5:
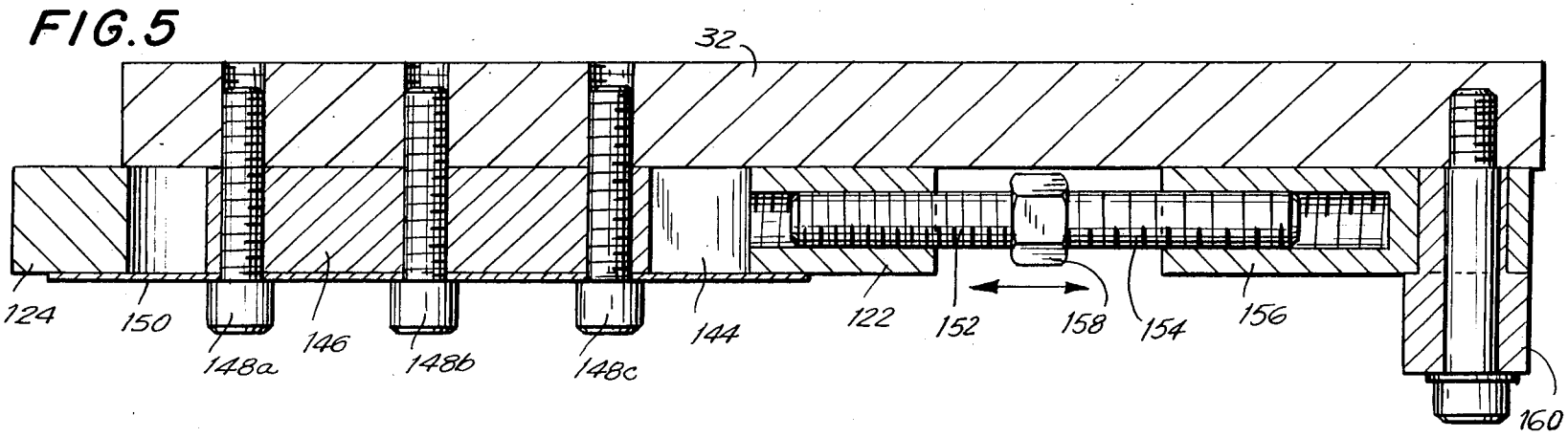
FIG. 5 is an enlarged sectional view as taken along the line 5—5 of FIG. 4.

To ensure the inking engagement between the inking and main rollers, the inking roller is not only adjustable lengthwise of the inclined slot 117 as described above, but the inking roller is also adjustable in the horizontal direction by either forwardly or rearwardly moving the rear legs 122 of the support arms 120 relative to the carriage. Each rear leg 122 is formed with a horizontally extending slot 144 (see FIG. 5) in which a horizontally extending guide block 146 is fixedly positioned. A set of anchoring bolts **148*a*, 148*b*, 148*c* fixedly secures the guide block 146 to the upper side wall of the carriage. A cover plate 150 is captured between the heads of the bolts 148*a*, 148*b*, 148*c* and the block 146**.

An elongated threaded adjustable element having a fine threaded section 152 and a coarse threaded section 154 extends in the direction of horizontal adjustment. The free end of threaded section 152 threadedly engages a tapped hole in the rear end of the leg 122. The free end of threaded section 154 threadedly engages a tapped hole in the front end of a locking block 156. An adjustable nut 158 is threadedly mounted on the elongated element 152, 154. An eccentric cam lock 160 is mounted for rotation about a horizontal axis on the locking block 160 between a locked and an unlocked position in which the locking block 160 cammingly engages or disengages, respectively, the respective upper side wall of the carriage.

As shown in FIG. 4, each locking block 160 is fixedly secured in its illustrated locked position. By turning each adjustable nut 158 on both sides of the fountain in either the forward or rearward direction, the leg 122 is likewise forwardly or rearwardly moved relative to the guide block 146 and the locking block 156, both of said blocks being fixed to the carriage. In turn, each support arm 120, 122 is moved forwardly or rearwardly, thereby adjusting the horizontal position of the inking roller 100 correspondingly. This adjustment is a fine adjustment because, for each turn of a respective nut 158, the inking roller 100 moves through a distance equal to the difference between the pitch of the threaded sections 152, 154.

Before describing the limited displacement of the inking roller in more detail and the means by which the limited displacement is effected, the various rollers 50, 70 and 100, together with all their respectively associated adjusting, positioning and mounting means, are all mounted on the carriage which, in turn, is operatively connected with the fountain to constitute an ink fountain assembly or unit.

In order to clean the die 18, the adjacent parts of the press and the ink fountain assembly itself, as well as to facilitate the replacement and/or cleaning of any of the components of the overall assembly, the entire fountain assembly can be moved as a unit by a motor driven lifting means rearwardly of the operating position, shown in solid lines in FIG. 1, on the bed 26 to a more rearward cleaning position. The lifting means includes a reversible electrical motor 162 and a speed reduction gear box 164, both being mounted below the bed 26 on a support plate 166 which extends downwardly and which is connected to the rear end of the bed 26. A tubular housing 168 contains a ball screw which is operative to move a horizontally reciprocating actuator 170 in either the forward or the rearward direction indicated by the double-headed arrow 172.

The lifting means includes a support link 174 which is pivotably connected to the outer side wall 40 of the bed 26, and to the outer end of the actuator 170, for supporting the components located below the bed 26. A translatory link 176 is pivotably connected to the support link 174, and to a drive link 178 at pivot point 177. A front driven link 184 is pivotably connected at pivot point 181 to a downwardly extending front lug 180 of the lower carriage side wall 36, and at pivot point 179 to the outer side wall 40 of the bed 26. The drive link 178 is also pivotably connected at its intermediate region to the link 184 at pivot point 179. A rear driven link 186 is pivotably connected at pivot point 187 to a downwardly extending rear lug 188 of the lower carriage side wall 36, and at pivot point 185 to the outer side wall 40 of the bed 26. Another set of front and rear driven links 184, 186 are located on the other side of the bed.

A collar 182 surrounds the upper ends of the links 178 and 184. A pair of springs (non-illustrated) is located within the collar between the links 178 and 184, and serve as a yieldable coupler to transmit a driving force from the drive link 178 to the driven link 184.

In operation, the motor 162 is operative to move the plunger 170 either forwardly or rearwardly (double-headed arrow 172) which, in turn, causes the drive link 178 and the driven links 184, 186 to pivot about pivot points 179, 185 in either direction of the double-headed arrow 190, thereby lifting the ink fountain assembly off, or lowering the assembly onto, the bed 26. In the lifted off condition, the ink fountain assembly is spaced further away from the die 18. If desired, the entire fountain assembly can be removed from the bed.

Figure 3:
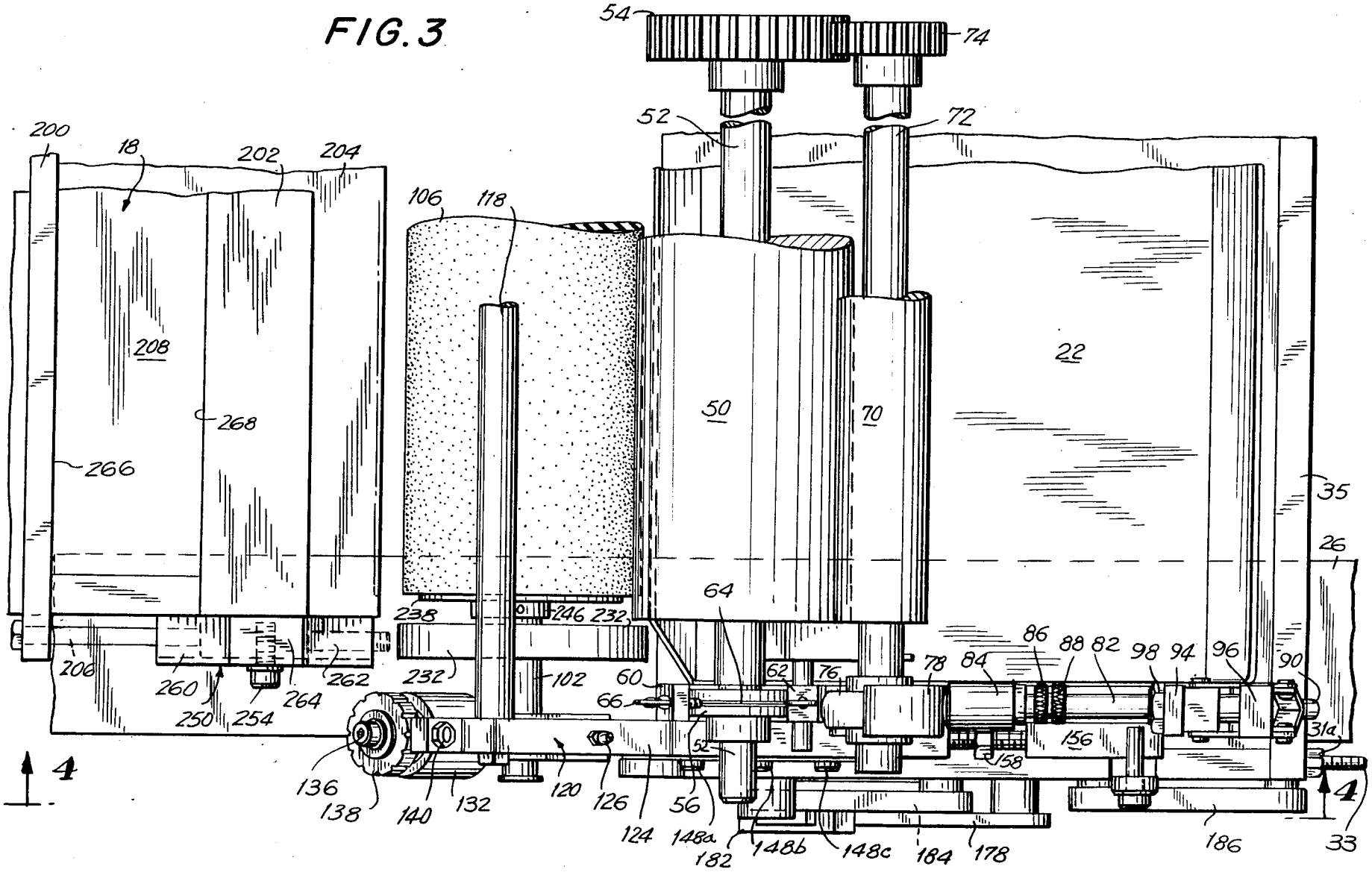
FIG. 3 is a partially broken away top plan view of the arrangement of FIG. 1.

As shown in FIG. 3, the die 18 is clamped between a stationary front jaw 200 and a movable rear jaw 202 which are interconnected by a pair of bolts 206 (only one shown) at opposite sides of the press above a die box 204. The jaws 200 and 202 are movable together with the die box 204. The upwardly facing surface 208 of the die 18 is engraved, and is the surface to be inked by the inking roller 100.

As noted previously, the die 18 is horizontally reciprocated by a die drive which includes, as shown in FIG. 4, a pivoting slotted cam 210 driven by a non-illustrated drive in the direction of the double-headed arrow 212. At an upper pivot point 214, a slide block 216 is mounted for sliding movement along a threaded rod 218. A pair of very stiff coil springs 220, 222 are mounted between the opposite sides of the slide block 216 and two pairs of adjustment nuts 224, 226. The forward end of the threaded rod 218 threadedly engages an internally threaded tubular member 228 which, in turn, is pivotably connected at pivot point 230 to a bottom extension of the die box 204. As the slotted cam 210 moves either forwardly or rearwardly in the direction of the arrow 212, this motion is transmitted to the die box 204 and to the die 18 clampingly mounted thereon for joint movement therewith. The die 18 travels lengthwise of the bed 26 through the aforementioned channel 44 and, in its end limiting rearmost position, as indicated by reference numeral 18' in FIG. 4, the die passes, at least in part, underneath the ink fountain assembly.

The limited displacement of the inking roller 100 is effected by displacing means operative for displacing the inking roller by a predetermined limited distance on the order of $\frac{1}{8}''$ out of its normal inking engagement with the main roller and into inking engagement with the engraved die surface 208 to permit the ink-laden inking roller to roll over and apply ink to the engraved die surface. Preferably, the displacing means is operatively associated with the die drive so that the ink is applied over the engraved die surface during the reciprocating movement of the die. Alternatively, a separate drive for the displacing means could be used.

The displacing means includes a pair of cam follower wheels 232, 234 mounted at opposite axial end regions of the inking roller shaft 102, each wheel being located between a respective axial end of the cylindrical body 104 and a bearing support 112. As shown in FIG. 7, the wheel 232 at the right side of the press is journaled for rotation on a tubular bushing 236 through which the shaft 102 passes. The right axial end of the cylindrical body 104 is closed by an annular plug 238 which is journaled for rotation on a tubular bushing 240 through which the shaft 102 passes. The axially spaced-apart bushings 236, 240 have respective annular flanges 242, 244 which are maintained axially apart from each other by an annular collar 246 whose position is fixed on the shaft 102 by a set screw 248.

The displacing means also includes a pair of cam shoes 250, 252 mounted at opposite sides of the press, each shoe being operative for engaging a respective wheel 232, 234 during a portion of the reciprocating movement. Each shoe is fixedly connected to the die box 204 by means of a bolt 254 which is adjustably mounted along the length of an elongated slot 256 formed in each shoe. As shown in FIG. 4 for the representative shoe 250, each shoe has a front tapered portion 260, a rear tapered portion 262, and an intermediate portion 264 of substantially constant height. The die 18 has a front edge 266 and a rear edge 268. The position of the bolt 254 in the slot 256 is preferably selected such that the rear edge 268 of the die is located approximately midway along the length of the front portion 260 of the shoe. The height of the engraved die surface 208 is located approximately midway of the height of the front tapered portion 260 of the shoe. The operative connection between each shoe and the die 18 permits the shoes to jointly move with the die in either direction of the double-headed arrow 270. When the die and the shoes are moved to the right or the left, as illustrated in FIG. 4, this is defined as the rearward or forward strokes, respectively.

Turning now to the successive views of FIGS. 9–13, the main roller 50, the inking roller 100, the wheel 232, the shoe 250 at the right side of the press (it being understood that the shoe 252 at the left side of the press is similarly situated relative to the wheel 234), and the die 18 have been shown in isolation in order to better illustrate the limited displacement of the inking roller during the rearward stroke of the displacing means.

Figure 9:
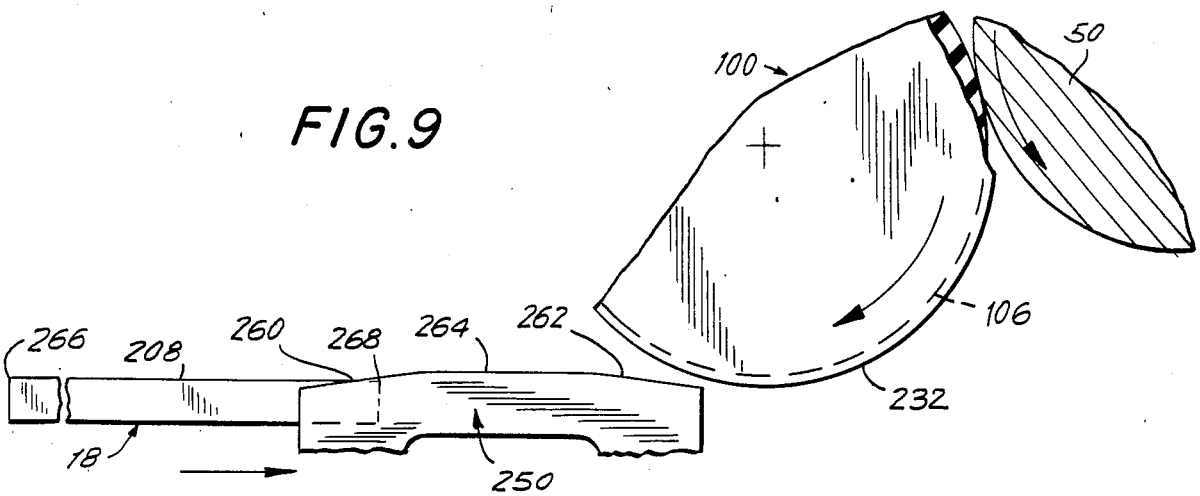

FIG. 9 shows the main and inking rollers in inking engagement just prior to the shoe 250 engaging the wheel 232. As the main roller turns counterclockwise, the inking roller is driven clockwise by the main roller. No ink has yet been transferred to the die.

Figure 10:
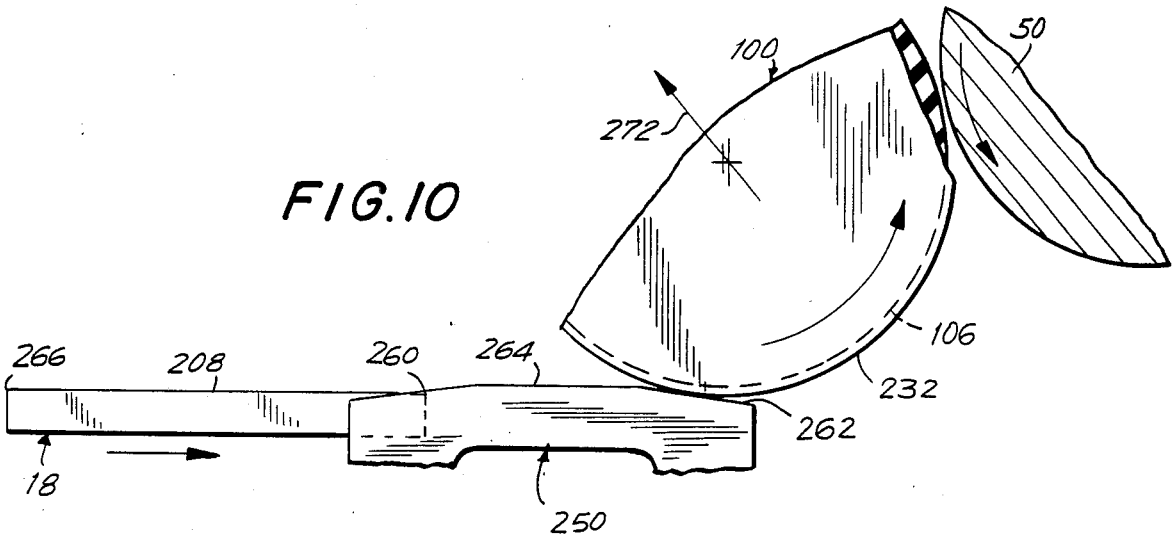

As shown in FIG. 10, the rear tapered portion 262 of the shoe 250 has engaged the wheel 232 and has gradually lifted the same. At the same time, the shoe 252 has engaged the wheel 234 and gradually lifted the same. The lifting of wheels 232, 234 causes the inking roller 100 and, more particularly, the ink-laden layer 106, to be lifted out of inking engagement with the main roller. The force exerted by the rear portions 262 of the shoes on the wheels is directed perpendicularly to the plane in which the upper surfaces of the rear tapered portions lie. However, the only component of said force which is permitted to act on the inking roller is in the direction of the arrow 272. This radially directed force component acts against the resisting force of the springs 142 to partially compress the same. The engagement of the rear portions 262 against the wheels, and the movement of the wheels upwardly along the length of the rear portions cause the wheels and the inking roller to turn in the counterclockwise direction. The inking roller is continuously and gradually lifted off the main roller due to the linear taper of the rear portions until the inking roller reaches an elevation which is above that of the engraved die surface 208.

Figure 11:
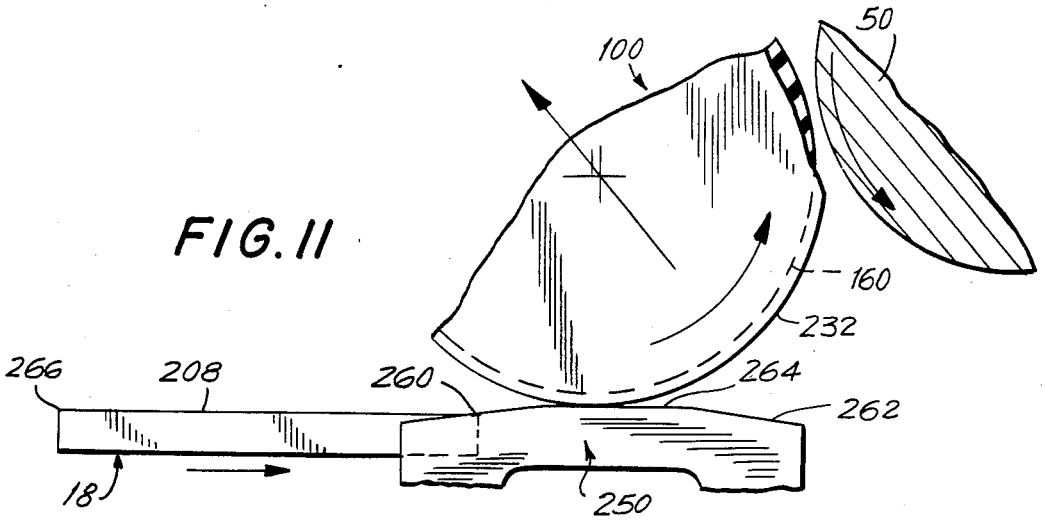

FIG. 11 shows the wheel 232 engaging the intermediate portion 264 of the shoe. When traveling from right to left along the length of the intermediate portion 264 illustrated in FIG. 11, the wheel 232 continues to rotate in the counterclockwise direction at the aforementioned constant elevation above the engraved die surface 208. The springs 142 remain in a partially compressed state. The ink-laden layer 106 still is out of inking engagement with the main roller as well as with the shoe itself.

FIG. 12 shows the wheel 232 after it has rolled about halfway down the downwardly tapered front portion 260 until substantially tangential contact is made between the outer circumferential surface of the layer 106 and the engraved die surface 208 at a zone A which is spaced rearwardly, e.g. on the order of ¼", from the rear edge 268. The layer 106 has been gradually and continuously lowered onto the die surface by the restoring action of the spring 142. The contact zone A is not strictly linear, but occupies a somewhat broad surface area due to some flattening of the resilient layer 106 against the metal die 18. The gentle lowering of the layer 106 on top of the die at an inwardly spaced zone from the edge 268 prevents ink splattering which otherwise would be caused if the layer 106 directly struck the edge 268.

During further rearward movement, the layer 106 rolls over and applies ink to the upper engraved surface 208 until the position of FIG. 13 is reached. During this rolling movement, the inking roller continued to rotate in a counterclockwise direction. FIG. 13 indicates the end limiting forward position wherein the layer 106 contacts the engraved die surface 208 at a zone B which is located up to, but not over, the front edge 266. Practically, zone B is spaced rearwardly, e.g. on the order of 1/64", from the front edge 266 of the die. Due to the resilient nature of the layer 106, the contact zone B is not strictly linear, but is somewhat flattened over a surface area. Again, the primary reason for not rotating the layer 106 over and past the front edge 266 is to avoid ink splattering and drying in the event that the layer 106 should fall off during the forward stroke, or directly strike the front edge 266 during the rearward stroke.

During the rearward stroke, the sequence of events of FIGS. 9–13 is reversed so that the layer 106 rotates from contact zone B to contact zone A along the engraved die surface in the clockwise direction illustrated by the arrow 274. Thereupon, the front tapered portion 260 lifts the wheel 232 and the inking roller off the die plate; the intermediate portion 264 maintains the layer 106 above the height of the die surface 208; and the rear tapered portion 262 lowers the inking roller back into inking engagement with the main roller 50, the latter engagement being assisted by the springs 142 which are constantly acting in the direction toward forcing the inking roller into engagement with the main roller. If desired, the magnitude of the restoring force exerted by each spring 142 during expansion, as well as the resisting force exerted by each spring 142 against compression, can be adjusted by turning the neck of the sleeve 130 relative to the tubular collar 132 to thereby effectively shorten the length of the spring 142 and its corresponding spring characteristic.

Thus, as described above, ink has been transferred from the main roller 50 onto the ink-laden layer 106 and, in turn, over the engraved die surface 208 during the forward stroke, as well as during the rearward stroke. The forward and rearward strokes are alternately repeated. During each pair of strokes, the wiping paper 19 is caused to wipe excess ink off the engraved die surface, leaving ink only in the wells of the engraving. Once the engraved die surface 208 has been wiped clean, a sheet of paper is fed onto the engraved die surface, and thereupon the press ram drive 14 moves downwardly to stamp the paper and transfer the ink from the wells to the paper, thereby completing the printing process.

Turning to FIG. 14, which is generally analogous to FIG. 7, another feature of this invention resides in being able to interchangeably mount an ink-absorbing resilient stockinette 275 over the cylindrical body 104 of the inking roller. By removing the axial end plugs 238 from the open ends of the cylindrical body 104, the resilient stockinette may be interchangeably mounted thereon. This feature may be used for changing ink colors, causing ink to be entered deeper into the wells of the engraving, as well as for increasing the lifetime of the inking roller itself because only the stockinette, i.e. the ink-absorbing layer 275, need be replaced.

It should be understood that the limited displacement which is on the order of ⅛" is merely intended to be exemplificative. The distance through which the inking roller can be displaced can be less or greater than ⅛".

It will be understood that each of the elements described above, or two or more together, may also find a useful application in other types of arrangements differing from the type described above.

While the invention has been illustrated and described as embodied in an ink transfer arrangement and method in a printing press, it is not intended to be limited to the details shown, since various modifications and structural changes may be made without departing in any way from the spirit of the present invention.

Without further analysis, the foregoing will so fully reveal the gist of the present invention that others can by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims:

1. In a printing press of the type including a reciprocatable die having an engraved surface to be inked, a die drive for reciprocating the die, and a press ram drive for pressing sheet material to be printed against the inked engraved die surface to produce intaglio printing, an ink transfer arrangement for transferring ink to the engraved die surface prior to the pressing, comprising:

(a) an ink fountain mounted on the press and containing a pool of ink;

(b) a rotatable fountain roller mounted on the fountain and having at least a portion of its outer circumferential surface in inking communication with the ink from the pool;

(c) means for rotating the fountain roller to distribute ink from the pool circumferentially along the outer circumferential surface of the fountain roller during rotation of the same;

(d) a rotatable inking roller normally mounted in inking engagement with the fountain roller for rotation by the same about an axis, said inking roller having an outer circumferential surface along which ink is distributed by the outer circumferential surface of the fountain roller during rotation of the same;

(e) means for mounting the inking roller for linear displacement relative to the fountain roller in a linear direction radial to the axis of rotation of the inking roller; and (f) displacing means operatively associated with the die drive, for displacing the inking roller along said linear direction radial to the axis of rotation of the inking roller by a predetermined distance out of inking engagement with the fountain roller but in close confronting relationship therewith, and into inking engagement with the engraved die surface to permit the ink-laden inking roller to roll over and apply ink to the engraved die surface during the reciprocating movement of the die.

2. The ink transfer arrangement as defined in claim 1, wherein the ink fountain is mounted on a carriage normally mounted in an operating position on a bed of the press; and further comprising means for moving the carriage from the operating position to a cleaning position off the bed to permit cleaning.

3. The ink transfer arrangement as defined in claim 2, wherein the carriage moving means includes a motor drive and a lifting mechanism operatively connected between the motor drive and the carriage, and operative for lifting the carriage off the bed from the operating to the cleaning position, and for lowering the carriage onto the bed from the cleaning to the operating position.

4. The ink transfer arrangement as defined in claim 1; and further comprising a rotatable auxiliary roller and means for adjustably mounting the auxiliary roller on the fountain closely adjacent to the fountain roller to control the thickness of the ink on the same.

5. The ink transfer arrangement as defined in claim 1, wherein the displacing means displaces the inking roller by a predetermined limited distance which is on the order of $\frac{1}{8}$ inch in a radially linear direction.

6. The ink transfer arrangement as defined in claim 1, wherein the inking roller has a cylindrical body; and further comprising means for interchangeably mounting an inkabsorbing element over the body.

7. An arrangement for transferring ink to an engraved die surface of a reciprocating die in an intaglio printing press, comprising:

(a) means for providing a pool of ink;

(b) means for distributing ink from the pool circumferentially along an outer circumferential surface of a rotatable fountain roller;

(c) means for normally mounting a rotatable inking roller in inking engagement with the fountain roller for rotation by the same about an axis to thereby distribute the ink on the fountain roller circumferentially along an outer circumferential surface of the inking roller;

(d) means for mounting the inking roller for linear displacement relative to the fountain roller in a linear direction radial to the axis of rotation of the inking roller; and (e) means for displacing the inking roller along said linear direction radial to the axis of rotation of the inking roller by a predetermined distance out of inking engagement with the fountain roller but in close confronting adjacent relationship therewith, and into inking engagement with the engraved die surface.

8. A method of transferring ink to an engraved die surface of a reciprocating die in an intaglio printing press, comprising the steps of:

(a) providing a pool of ink;

(b) distributing ink from the pool circumferentially along an outer circumferential surface of a rotatable fountain roller;

(c) normally mounting a rotatable inking roller in inking engagement with the fountain roller for rotation by the same about an axis to thereby distribute the ink on the fountain roller circumferentially along an outer circumferential surface of the inking roller;

(d) mounting the inking roller for linear displacement relative to the fountain roller in a linear direction radial to the axis of rotation of the inking roller; and (e) displacing the inking roller along said linear direction radial to the axis of rotation of the inking roller by a predetermined distance out of inking engagement with the fountain roller but in close confronting adjacent relationship therewith, and into inking engagement with the engraved die surface to permit the ink-laden inking roller to roll over and apply ink to the engraved die surface jointly during the reciprocating die movement.

9. In a printing press of the type including a reciprocatable die having an engraved surface to be inked, a die drive for reciprocating the die, and a press ram drive for pressing sheet material to be printed against the inked engraved die surface to produce intaglio printing, an ink transfer arrangement for transferring ink to the engraved die surface prior to the pressing, comprising:

(a) an ink fountain counted on the press and containing a pool of ink;

(b) a rotatable fountain roller mounted on the fountain and having at least a portion of its outer circumferential surface in inking communication with the ink from the pool, said fountain roller including a cylindrical body centered on a shaft;

(c) means for rotating the fountain rollrer to distribute ink from the pool circumferentially along the outer circumferential surface of the fountain roller during rotation of the same;

(d) a rotatable inking roller normally mounted in inking engagement with the fountain roller for rotation by the same about an axis, said inking roller having a outer circumferential surface along which ink is distributed by the outer circumferential surface of the fountain roller during rotation of the same;

(e) means for mounting the inking roller for limited displacement relative to the fountain roller in direction transverse to the axis of rotation of the inking roller;

(f) displacing means operatively associated with the die drive, for displacing the inking roller by a predetermined limited distance out of inking engagement with the fountain roller, and into inking engagement with the engraved die surface to permit the ink-laden inking roller to roll over and apply ink to the engraved die surface during the reciprocating movement of the die; and (g) means for readily removably mounting the fountain roller on the fountain, including a pair of circular bearings at opposite end regions of the shaft for journaling the same, a pair of circumferentially-incomplete supports on the fountain for supporting the bearings, and a pair of locks for fixedly mounting each bearing in a respective support.

10. The ink transfer arrangement as defined in claim 9, wherein each circular bearing has an annular groove, and wherein each lock includes a turnable element having a leading end lockingly received in a respective bearing groove.

11. In a printing press of the type including a reciprocatable die having an engraved surface to be inked, a die drive for reciprocating the die, and a press ram drive for pressing sheet material to be printed against the inked engraved die surface to produce intaglio printing, an ink transfer arrangement for transferring ink to the engraved die surface prior to the pressing, comprising:

(a) an ink fountain mounted on the press and containing a pool of ink;

(b) a rotatable fountain roller mounted on the fountain and having at least a portion of its outer circumferential surface in inking communication with the ink from the pool;

(c) means for rotating the fountain roller to distribute ink from the pool circumferentially along the outer circumferential surface of the fountain roller during rotation of the same;

(d) a rotatable inking roller normally mounted in inking engagement with the fountain roller for rotation by the same about an axis, said inking roller having an outer circumferential surface along which ink is distributed by the outer circumferential surface of the fountain roller during rotation of the same;

(e) means for mounting the inking roller for limited displacement relative to the fountain roller in a direction transverse to the axis of rotation of the inking roller;

(f) displacing means operatively associated with the die drive, for displacing the inking roller by a predetermined limited distance out of inking engagement with the fountain roller, and into inking engagement with the engraved die surface to permit the ink-laden inking roller to roll over and apply ink to the engraved die surface during the reciprocating movement of the die;

(g) a rotatable auxiliary roller including a cylindrical bocy centered on a shaft; and (h) means for adjustably mounting the auxiliary roller on the fountain closely adjacent to the fountain roller to control the thickness of the ink on the same, said adjustable mounting means including a pair of circular bearings at opposite end regions of the shaft for journaling the same, a pair of circumferentially-incomplete movable supports on the fountain for supporting the bearings and the auxiliary roller in an operating condition, and means for fixedly positioning each movable support and the auxiliary roller in the operating condition.

12. The ink transfer arrangement as defined in claim 11, wherein each positioning means includes an elongated member extending the direction of adjustment, an abutment mounted on one end region of the member, and a handle mounted at the opposite end region of the member, said handle being manually movable between an engaged position in which the abutment engages the respective support and positions the auxiliary roller in the operating condition, and a released position in which the abutment is disengaged from the respective support to permit the auxiliary roller to be readily removed therefrom.

13. The ink transfer arrangement as defined in claim 12, wherein each positioning means includes means for adjusting the position of the respective abutment on its associated member, and means for yieldably and constantly urging each abutment against its respective support in the engaged position.

14. In a printing press of the type including a reciprocatable die having an engraved surface to be inked, a die drive for reciprocating the die, and a press ram drive for pressing sheet material to be printed against the inked engraved die surface to produce intaglio printing, an ink transfer arrangement for transferring ink to the engraved die surface prior to the pressing, comprising:

(a) an ink fountain mounted on the press and containing a pool of ink;

(b) a rotatable fountain roller mounted on the fountain and having at least a portion of its outer circumferential surface in inking communication with the ink from the pool;

(c) means for rotating the fountain roller to distribute ink from the pool circumferentially along the outer circumferential surface of the fountain roller during rotation of the same;

(d) a rotatable inking roller normally mounted in inking engagement with the fountain roller for rotation by the same about an axis, said inking roller having an outer circumferential surface along which ink is distributed by the outer circumferential surface of the fountain roller during rotation of the same;

(e) means for mounting the inking roller on the fountain for limited displacement relative to the fountain roller in a direction transverse to the axis of rotation of the inking roller; and (f) displacing means operatively associated with the die drive, for displacing the inking roller by a predetermined limited distance out of inking engagement with the fountain roller, and into inking engagement with the engraved die surface to permit the ink-laden inking roller to roll over and apply ink to the engraved die surface during the reciprocating movement of the die.

15. The ink transfer arrangement as defined in claim 14, wherein the inking roller includes a cylindrical body centered on a shaft extending along the axis of rotation, and wherein the inking roller mounting means includes a pair of adjustable mounted support arms on opposite sides of the fountain, a pair of circular bearings at opposite end regions of the shaft for journaling the same, a pair of circumferentially-incomplete supports mounted on the arms for supporting the bearings, and a pair of locks for fixedly mounting the bearings in their respective supports on the arms.

16. The ink transfer arrangement as defined in claim 15, wherein each circular bearing has an annular groove, and wherein each lock includes a turnable element having a leading end lockingly received in a respective groove.

17. In a printing press of the type including a reciprocatable die having an engraved surface to be inked, a die drive for reciprocating the die, and a press ram drive for pressing sheet material to be printed against the inked engraved die surface to produce intaglio printing, an ink transfer arrangement for transferring ink to the engraved die surface prior to the pressing, comprising:

(a) an ink fountain mounted on the press and containing a pool of ink;

(b) a rotatable fountain roller mounted on the fountain and having at least a portion of its outer circumferential surface in inking communication with the ink from the pool;

(c) means for rotating the fountain roller to distribute ink from the pool circumferentially along the outer circumferential surface of the fountain roller during rotation of the same;

(d) a rotatable inking roller normally mounted in inking engagement with the fountain roller for rotation by the same about an axis, said inking roller having an outer circumferential surface along which ink is distributed by the outer circumferential surface of the fountain roller during rotation of the same;

(e) means for mounting the inking roller for limited displacement relative to the fountain roller in a direction transverse to the axis of rotation of the inking roller, said inking roller mounting means including means for constantly and yieldably urging the inking roller into inking engagement with the fountain roller; and (f) displacing means operatively associated with the die drive, for displacing the inking roller against the constant urging of the urging means in a radially linear direction by a predetermined limited distance out of inking engagement with the fountain roller, and into inking engagement with the engraved die surface to permit the ink-laden inking roller to roll over and apply ink to the engraved die surface during the reciprocating movement of the die, said urging means automatically returning the inking roller into inking engagement with the fountain roller after said limited displacement.

18. The ink transfer arrangement as defined in claim 17; and further comprising means for adjusting the magnitude of the urging exerted by the urging means.

19. In a printing press of the type including a reciprocatable die having an engraved surface to be inked, a die drive for reciprocating the die, and a press ram drive for pressing sheet material to be printed against the inked engraved die surface to produce intaglio printing, an ink transfer arrangement for transferring ink to the engraved die surface prior to the pressing, comprising:

(a) an ink fountain mounted on the press and containing a pool of ink;

(b) a rotatable fountain roller mounted on the fountain and having at least a portion of its outer circumferential surface in inking communication with the ink from the pool;

(c) means for rotating the fountain roller to distribute ink from the pool circumferentially along the outer circumferential surface of the fountain roller during rotation of the same;

(d) a rotatable inking roller normally mounted in inking engagement with the fountain roller for rotation by the same about an axis, said inking roller having an outer circumferential surface along which ink is distributed by the outer circumferential surface of the fountain roller during rotation of the same;

(e) means for mounting the inking roller for limited displacement relative to the fountain roller in a direction transverse to the axis of rotation of the inking roller, said inking roller mounting means mounting the inking roller on the fountain for adjusting movement relative to the fountain roller, including a pair of support arms on opposite sides of the fountain and each arm operatively supporting opposite axially spaced-apart end regions of the inking roller, a pair of guide blocks each fixedly connected to the opposite sides of the fountain and each being received in an elongated slot formed in a respective arm, means for finely adjusting the position of each arm relative to its respective guide block, and means for fixedly locking each arm in a selected adjusted position; and (f) displacing means operatively associated with the die drive, for displacing the inking roller by a predetermined limited distance out of inking engagement with the fountain roller, and into inking engagement with the engraved die surface to permit the ink-laden inking roller to roll over and apply ink to the engraved die surface during the reciprocating movement of the die.

20. The ink transfer arrangement as defined in claim 19, wherein the finely adjusting means includes a threaded element elongated in the direction of adjustment, said threaded element having a pair of co-linear threaded sections of different pitch, and a turnable member threadedly mounted on the threaded element.

21. The ink transfer arrangement as defined in claim 19, wherein the locking means includes a manually-turnable handle mounted on each arm for movement between a locked position in which the respective arm lockingly engages the respective side of the fountain, and a released position in which the respective arm is disengaged from the respective fountain side.

22. In a printing press of the type including a reciprocatable die having an engraved surface to be inked, a die drive for reciprocating the die, and a press ram drive for pressing sheet material to be printed against the inked engraved die surface to produce intaglio printing, an ink transfer arrangement for transferring ink to the engraved die surface prior to the pressing, comprising:

(a) an ink fountain mounted on the press and containing a pool of ink;

(b) a rotatable fountain roller mounted on the fountain and having at least a portion of its outer circumferential surface in inking communication with the ink from the pool;

(c) means for rotating the fountain roller to distribute ink from the pool circumferentially along the outer circumferential surface of the fountain roller during rotation of the same;

(d) a rotatable inking roller normally mounted in inking engagement with the fountain roller for rotation by the same about an axis, said inking roller having an outer circumferential surface along which ink is distributed by the outer circumferential surface of the fountain roller during rotation of the same, said inking roller including a cylindrical body centered on a shaft extending along the axis of rotation;

(e) means for mounting the inking roller for limited displacement relative to the fountain roller in a direction transverse to the axis of rotation of the inking roller; and (f) displacing means operatively associated with the die drive, for displacing the inking roller by a predetermined limited distance out of inking engagement with the fountain roller, and into inking engagement with the engraved die surface to permit the ink-laden inking roller to roll over and apply ink to the engraved die surface during the reciprocating movement of the die, said displacing means including a pair of cam follower wheels mounted at opposite end regions of the shaft, and a pair of cam shoes operatively connected with the die drive to jointly move with the reciprocating movement of the die, each shoe engaging a respective wheel during a part of the reciprocating movement to effect said limited displacement.

23. The ink transfer arrangement as defined in claim 22, wherein the die drive moves the die and shoes along a rearward stroke in a rearward direction toward the inking roller; and wherein each shoe has a rear portion for lifting the respective wheel and, in turn, the inking roller out of inking engagement with the fountain roller; and wherein each shoe has a front portion for lowering the respective wheel and, in turn, the inking roller into rolling inking contact with the engraved die surface at a location spaced forwardly of a rear edge of the die; and wherein the inking roller maintains rolling inking contact with and rolls in one circumferential direction along the engraved die surface during further rearward movement up to a location spaced rearwardly of a front edge of the die.

24. The ink transfer arrangement as defined in claim 23, wherein the die drive returns the die and shoes along a forward stroke in the forward direction away from the inking roller, and wherein the inking roller rolls in the opposite circumferential direction along the engraved die surface until the front portion of each shoe lifts the respective wheel and, in turn, the inking roller out of rolling inking contact with the engraved die surface; and wherein the rear portion of each shoe lowers the respective wheel during further forward movement and, in turn, the inking roller is lowered and returned into inking engagement with the fountain roller.

25. The ink transfer arrangement as defined in claim 24, wherein each shoe has linearly tapered front and rear portions for continuously lifting and lowering the inking roller during the lifting and lowering parts of the rearward and forward strokes.

26. The ink transfer arrangement as defined in claim 24, wherein each shoe has an intermediate portion of constant height between its respective front and rear portions, each intermediate portion being operative for maintaining the inking roller at a constant elevation during a part of the forward and rearward strokes.

* * * * *